US009776188B1

(12) United States Patent
Kamees et al.

(10) Patent No.: US 9,776,188 B1
(45) Date of Patent: Oct. 3, 2017

(54) ADJUSTABLE TEST TUBE HOLDER

(71) Applicant: Heathrow Scientific LLC, Vernon Hills, IL (US)

(72) Inventors: Gary Dean Kamees, Gurnee, IL (US); Timothy Gerard Driscoll, Burlington, WI (US); Alice Marie Jandrisits, Des Plaines, IL (US)

(73) Assignee: Heathrow Scientific LLC, Vernon Hills, IL (US)

( * ) Notice: Subject to any disclaimer, the term of this patent is extended or adjusted under 35 U.S.C. 154(b) by 0 days.

(21) Appl. No.: 15/084,315

(22) Filed: Mar. 29, 2016

(51) Int. Cl.
*B01L 9/06* (2006.01)
*B01L 9/00* (2006.01)

(52) U.S. Cl.
CPC *B01L 9/06* (2013.01); *B01L 9/50* (2013.01); *B01L 2200/023* (2013.01); *B01L 2200/025* (2013.01); *B01L 2300/0809* (2013.01)

(58) Field of Classification Search
CPC . B01L 9/06; B01L 2200/023; B01L 2200/025
See application file for complete search history.

(56) References Cited

U.S. PATENT DOCUMENTS

| | | | |
|---|---|---|---|
| 1,980,930 A | 11/1934 | Reyniers | |
| 2,189,989 A | 2/1940 | Lichtman | |
| 3,379,315 A | 4/1968 | Broadwin | |
| 3,625,485 A | 12/1971 | Adler | |
| 3,744,665 A | 7/1973 | Spoto | |
| 3,918,920 A | 11/1975 | Barber | |
| 4,135,660 A | 1/1979 | Conn et al. | |
| 4,482,522 A | 11/1984 | Baudisch et al. | |
| 4,938,369 A | 7/1990 | Carilli | |
| 4,944,924 A | 7/1990 | Mawhirt et al. | |
| 5,036,989 A | 8/1991 | Carilli | |
| 5,137,693 A | 8/1992 | Mawhirt | |
| 5,285,907 A | 2/1994 | Franchere et al. | |
| 5,378,433 A | 1/1995 | Duckett et al. | |
| 5,632,388 A * | 5/1997 | Morrison | B01L 9/06 211/170 |

(Continued)

FOREIGN PATENT DOCUMENTS

| | | |
|---|---|---|
| JP | 2010078483 | 4/2010 |
| JP | 2010201396 | 9/2010 |

OTHER PUBLICATIONS

Daiger 1996 Catalog, "Nalgene Unwire Test Tube Wires, 50ml Centrifuge Tube Rack, Epoxy Coated Wire Test Tube Racks, Nalgene Microcentrifuge Tube Racks, Nalgene Floating Microtube Racks, Radioimmunoassay Tube Racks, Stack Rack Test Tube Racks" pp. 298-300.

(Continued)

*Primary Examiner* — Paul Hyun
(74) *Attorney, Agent, or Firm* — Michael Best & Friedrich LLP

(57) ABSTRACT

A test tube holder is configurable to support a combination of a first test tube type and a second test tube type. The test tube holder has a base and a plurality of independently adjustable support members, each coupled to and rotatable with respect to the base between a first position, where the support member is configured to support the first test tube type, and a second position, where the first support member is configured to support the second test tube type.

11 Claims, 5 Drawing Sheets

(56) References Cited

U.S. PATENT DOCUMENTS

| | | | |
|---|---|---|---|
| 5,985,219 | A | 11/1999 | Lind |
| 6,083,462 | A | 7/2000 | Ikonen et al. |
| 6,543,100 | B1 | 4/2003 | Finley et al. |
| 6,640,981 | B2 | 11/2003 | Lafond et al. |
| 7,000,785 | B2 | 2/2006 | Jafari et al. |
| 8,367,024 | B2 | 2/2013 | Itoh |
| 2002/0108917 | A1 | 8/2002 | Maruyama |
| 2003/0215370 | A1 | 11/2003 | Itoh |
| 2005/0180895 | A1 | 8/2005 | Itoh |
| 2007/0163973 | A1 | 7/2007 | Smokowicz et al. |
| 2014/0118733 | A1 | 5/2014 | Harward |
| 2015/0101911 | A1 | 4/2015 | Friedman |

OTHER PUBLICATIONS

Heathrow Scientific 1999 Catalog, "Interlocking Racks: Cube Rack, Interlocking Racks: 20-Well Tube Racks, Interlocking Racks: 4-Way Microtube Racks, Tube Racks: 50-0Well or 100-Well EPS Tube Racks, Tube Racks: 80-Well Microtube Racks, Economy Test Tube Racks" pp. 2, 4.

Daiger 1999-2000 Catalog, "81-Well Freezer Storage Racks, Soft Foam Tube Racks, Micro-sample Test Tube Rack, Nalgene Polycarbonate Test Tube Racks, Snap Together Racks," pp. 491, 493, 495.

Daigger 2000 Catalog, "Tube Racks, 50-mL Single Tube Holder, No-Wire Microtube Racks, 80-Well Microtube Rack," pp. 523, 526 and 527.

Daigger Life Science Edition 2001 Catalog, "Thermal Cycler Tube Racks," 2 pages.

Daigger 2002-2003 Catalog, "Nova Rack, Nalgene Unwire Test Tube Retainers, Nalgene Stackable Test Tube Racks, Slant Tube Racks, Economy Culture Tube Racks, Test Tubes with Drying Pegs, Stainless Steel "Z" Racks, 50-mL Single Tube Holder, 96-Well Reversible Racks, Microtube Racks, 3-Way Racks," pp. 652-658.

Daigger 2003 Catalog, "1-Well Racks, 15- and 30-mL Tube Wire Racks, Snap-Together Conical Tube Racks, Economy Test Tube Racks, Adjustable-Shelf Test Tube Rack, Certifuge Bottle Rack," 4 pages.

Daigger 2004-2005 Catalog, "Snap-Together Test Tube Racks, Economy Test Tube Racks," p. 80.

Daigger 2006 Catalog, "Arctic Squares Cryostorage Boxes, Locking Microtube Storage Boxes, OneRack Test Tube Racks," 4 pages.

* cited by examiner

ADJUSTABLE TEST TUBE HOLDER

BACKGROUND

The present disclosure relates to a test tube holder and more specifically to a test tube holder able to store test tubes of different sizes.

In laboratory settings, the need to store test tubes is a constant need. Dependent upon the types of experiments being conducted at any given time, different types of test tubes may be used and later stored. As such, flexibility is desired as to the number and type of test tubes that a test tube holder can accommodate.

SUMMARY

In one aspect, a test tube holder that is configurable to support a combination of a first test tube type and a second test tube type. The test tube holder having a base, and a first support member coupled to and rotatable with respect to the base between a first position, where the first support member is configured to support the first test tube type, and a second position, where the first support member is configured to support the second test tube type.

In another aspect, a test tube holder including a base, and a first support member defining one or more apertures therein, the first support member being coupled and rotatable with respect to the base between a first position, where the one or more apertures are a first distance from the base, and a second position, where the one or more apertures are a second distance from the base different than the first distance.

In yet another aspect, a test tube holder configured to support a combination of a first test tube type and a second test tube type. The test tube holder having a base, a plurality of support members adjustably coupled to the base, and a plurality of test tube stations, where each support member of the plurality of support members at least partially defines a unique portion of the test tube stations, and where each support member is adjustable between a first position wherein the unique portion of the test tube stations are configured to support the first test tube type, and a second position where the unique portion of test tube stations are configured to support the second test tube type.

Other aspects of the disclosure will become apparent by consideration of the detailed description and accompanying drawings.

DETAILED DESCRIPTION

Before any embodiments of the test tube holder are explained in detail, it is to be understood that the test tube holder is not limited to the details set forth in the following description or illustrated in the accompanying drawings. The test tube holder is capable of supporting other implementations and of being practiced or of being carried out in various ways.

Figure 1:
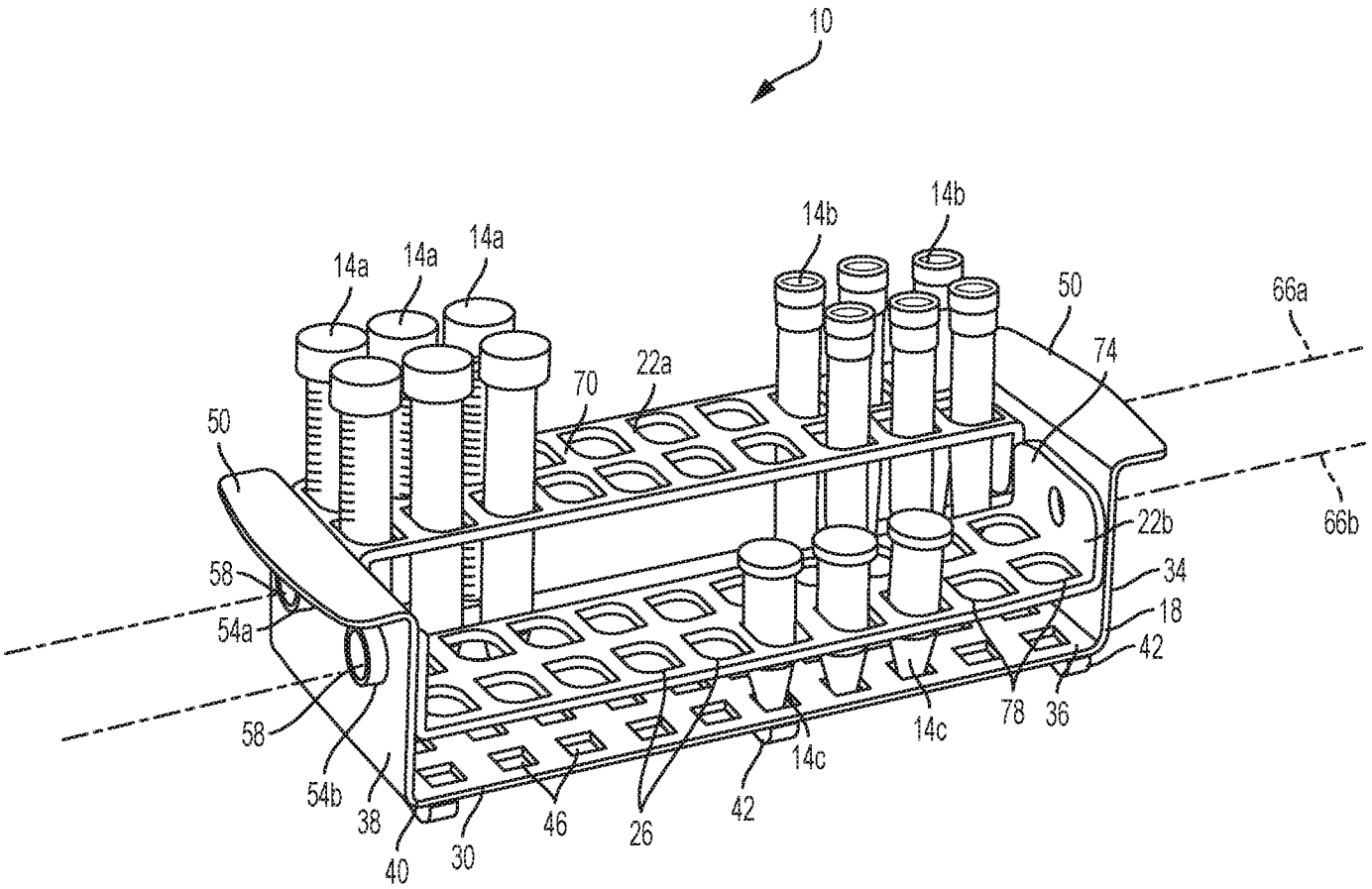
FIG. 1 is a perspective view of the test tube holder with the support members in a first configuration.
Figure 2:
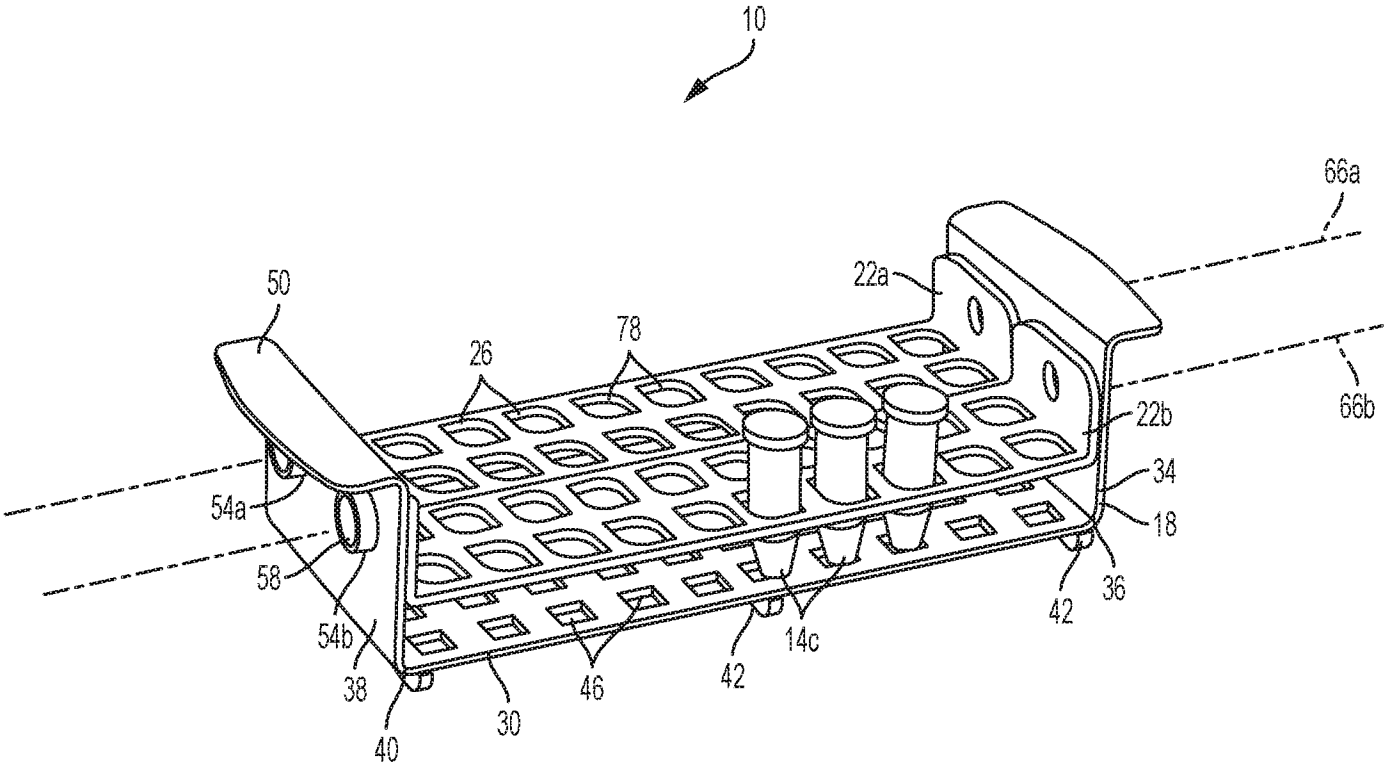
FIG. 2 is a perspective view of the test tube holder of FIG. 1 with the support members in a second configuration.
Figure 3:
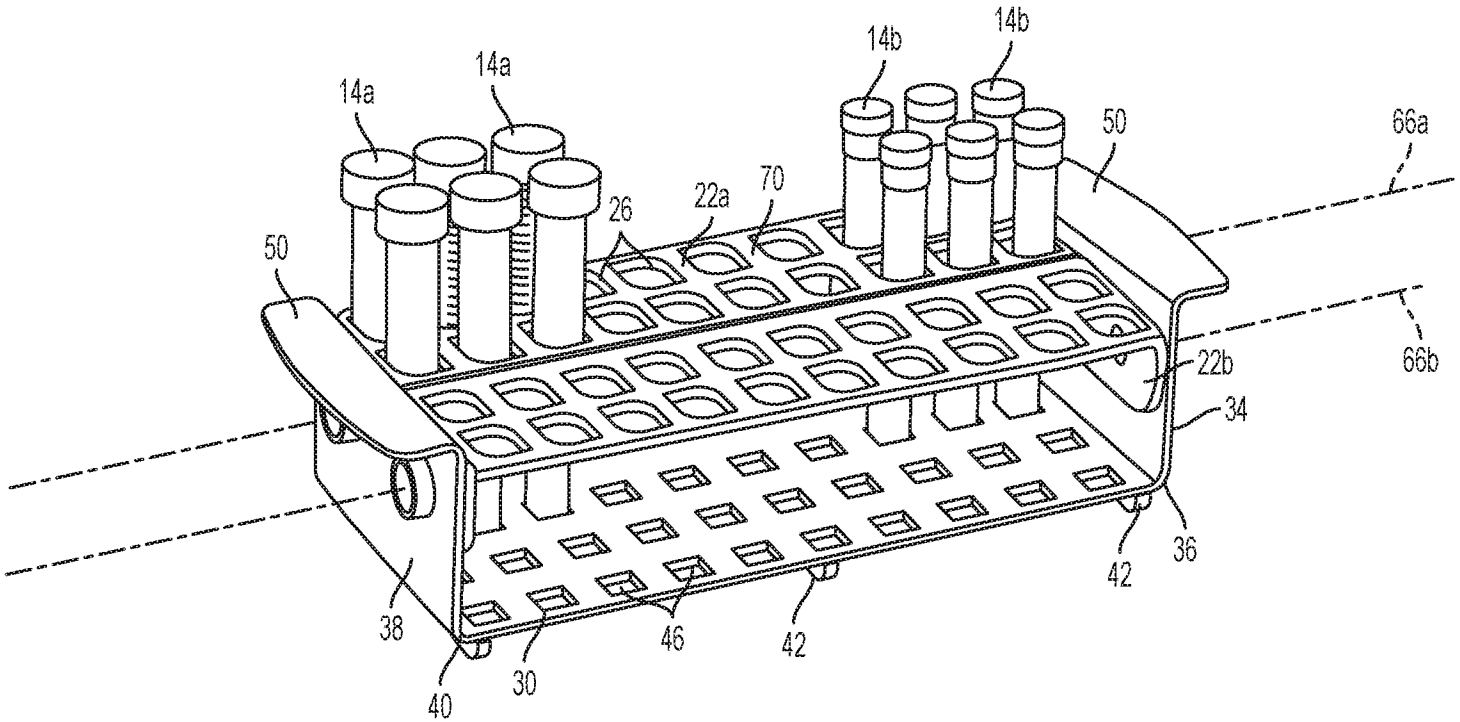
FIG. 3 is a perspective view of the test tube holder of FIG. 1 with the support members in a third configuration.
Figure 4:
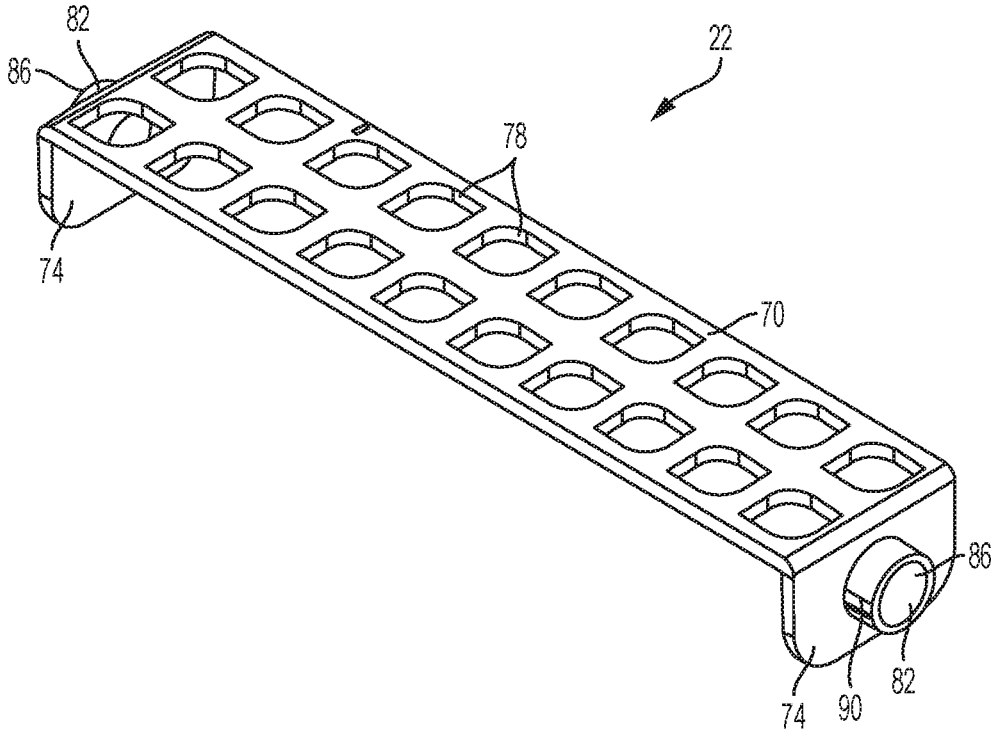
FIG. 4 is a perspective view of a support member.
Figure 5:
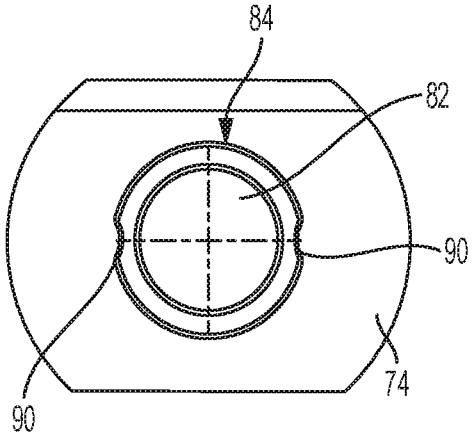
FIG. 5 is an end view of the support member of FIG. 4.

FIGS. 1-3 generally illustrate a test tube holder 10 configured to store various types of test tubes 14*a*, 14*b*, 14*c* simultaneously. The test tube holder 10 includes a base 18, and a plurality support members 22 independently adjustable with respect to the base 18. When assembled, the test tube holder 10 provides a plurality of test tube storage stations 26, each at least partially defined by the base 18 and a corresponding one of the plurality of support members 22, and configured to store a respective test tube 14. Generally speaking, each station 26 stores a corresponding test tube 14 in a substantially upright orientation. For the purposes of this application, different "types" of test tubes 14*a*, 14*b*, 14*c* are defined as test tubes that vary from one another in one or more ways. For example, the test tubes may have different heights, diameters, storage volumes, shapes, or be made of different materials, and the like.

Illustrated in FIGS. 1-3, the base 18 of the test tube holder 10 is substantially U-shaped having a bottom portion or floor 30, a first side wall 34 extending substantially perpendicular from a first edge 36 of the bottom portion 30, and a second side wall 38 opposite the first side wall 34 and extending substantially perpendicular from a second edge 40 of the bottom portion 30. The base 18 also includes a set of feet 42 extending from the bottom portion 30 and configured to support and elevate the base 18 relative to a support surface such as a lab table or shelf (not shown).

The top surface of the bottom portion 30 of the base 18 is substantially planar, but it defines a plurality of recesses or cups 46. Each cup 46 is sized to receive at least a portion of a test tube 14 therein and to define at least a portion of a storage station 26. In the illustrated construction, the cups 46 are spread substantially evenly over the bottom portion 30 as a rectangular array. More specifically, the cups 46 are positioned in four rows, each row having ten cups 46 for a total of forty cups 46. The cups 46 generally have a shape that corresponds to the bottom of a test tube 14 such that when the bottom of a test tube 14 is at least partially inserted into the cup 46, it will help support the test tube 14 vertically while also restricting radial movement of the test tube 14 with respect to the bottom portion 30. In the illustrated construction, the cups 46 are generally concave in shape, however in alternative constructions, the cups 46 may include apertures (not shown), extending through the bottom portion 30 and sized to receive at least a portion of a test tube 14 therein.

The first and second side walls 34, 38 of the base 18 each extend upwardly and substantially perpendicular from a corresponding edge 36, 40 of the bottom portion 30 and terminate in opposing handles 50. In the illustrated construction, the two side walls 34, 38 are generally oriented parallel to one another and the handles 50 are generally perpendicular to the side walls 34, 38.

Figure 6:
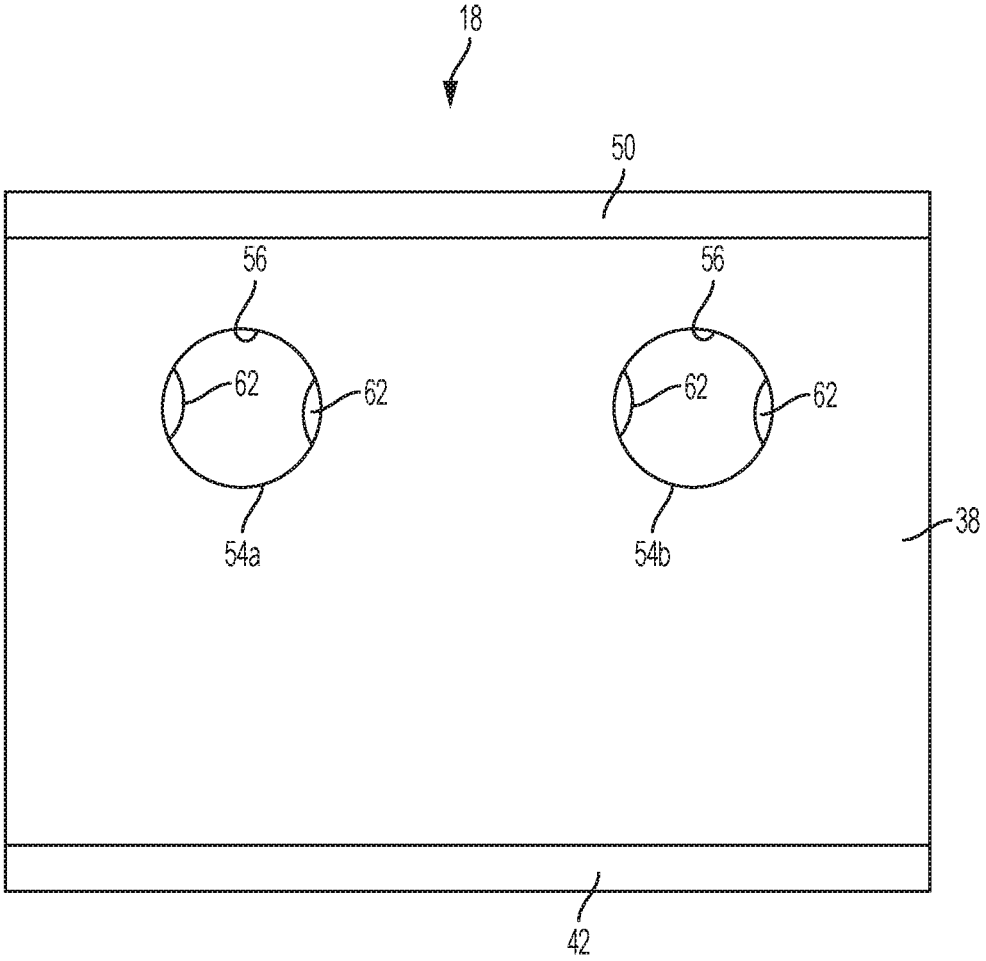
FIG. 6 is an end view of a base of the test tube holder of FIG. 1.

The first and second side walls 34, 38 also define a plurality of mounting apertures 54 extending therethrough. Each mounting aperture 54 is substantially circular in shape, defining an inner diameter 56 that substantially corresponds with the outer diameter 84 of a corresponding rotating lug 58 (described below). Furthermore, each mounting aperture 54 includes a pair of locking protrusions 62, (FIG. 6), extending radially inwardly from the inner diameter 56 of the aperture 54 and configured to engage a rotating lug 58 of a corresponding support member 22. In the illustrated construction, the two locking protrusions 62 are positioned diametrically opposite one another (i.e., 180 degrees apart). In alternative constructions, more or fewer locking protrusions may be included.

The mounting apertures 54 are generally oriented in pairs such that an aperture 54 formed in the first side wall 34 is substantially coaxially aligned with an aperture 54 formed in the second side wall 38 to define an axis of rotation 66 therethrough. In the illustrated construction, the walls 34, 38 define two pairs of apertures 54*a*, 54*b*, each defining a corresponding axis of rotation 66*a*, 66*b*. In alternative constructions, more or fewer sets of apertures 54 may be included as necessary.

Illustrated in FIGS. 1-5, the test tube holder 10 also includes a plurality of support members 22. Each support member 22 is coupled to the base 18 and at least partially defines a unique portion of the storage stations 26. Each support member 22 is also individually adjustable (i.e., rotatable) with respect to the base 18 to at least partially dictate the type of test tube 14 which may be stored in the portion of storage stations 26 for which it is associated (i.e., the storage stations 26 that particular support member 22 at least partially defines). The user may individually adjust each support member 22, to modify the type of test tube 14 the associated portion of stations 26 may accommodate. Taken together, the user is able to create unique combinations of stations 26 configured to store various quantities of different types of test tubes 14 by adjusting each support member 22 individually.

In the illustrated construction, the test tube holder 10 includes a first support member 22*a* and a second support member 22*b*, each associated with a respective half of the storage stations 26. However in alternative constructions, more or fewer support members 22 may be utilized. Still further, the portion of stations 26 each support member 22 is associated with may not be evenly distributed (i.e., one support member is associated with ⅓ of the stations while another support member is associated with ⅔).

The first support member 22*a* of the test tube holder 10 is substantially "U-shaped" having a bottom wall 70 and a pair of side walls 74 extending perpendicularly from the bottom wall 70 at opposite sides thereof. The bottom wall 70, in turn, defines a plurality of "tear-drop" shaped apertures 78, each sized to allow a corresponding test tube 14 to pass therethrough. In the illustrated construction, the apertures 78 are evenly distributed along the bottom wall 70 in a rectangular array (i.e., two rows, each row having ten apertures). More specifically, the apertures 78 are positioned such that, when the first support member 22*a* is coupled to the base 18, each aperture 78 is substantially vertically aligned with a corresponding cup 46 of the base 18.

The side walls 74 of the first support member 22*a* each include a rotating lug 82 extending outwardly therefrom. Both rotating lugs 82 are substantially coaxially aligned with one another to form a pair. The distal ends 86 of the rotating lugs 82 are configured to be at least partially received within the first pair of mounting apertures 54*a* of the base 18, allowing the first support member 22*a* to rotate about the first axis 66*a*.

Each rotating lug 82 is substantially cylindrical in shape and has an outer diameter 84 that substantially corresponds with the inner diameter 56 of a corresponding mounting aperture 54, to permit relative rotation therebetween. The rotating lug 82 also includes a pair of locking grooves 90, each extending radially inwardly from the outer diameter 84 and configured to releaseably engage the locking protrusions 62 formed in the corresponding mounting aperture 54. When engaged, the locking protrusions 62 and locking grooves 90 resist the relative rotation between the first support member 22*a* and the base 18. As such, the engagement between the protrusions 62 and the grooves 90 causes the first support member 22*a* to index between engagement positions whereby the engagement force rotationally fixes the first support member 22*a* in place until the engagement force is overcome and the first support member 22*a* is able to rotate with respect to the base 18.

The locking grooves 90 are positioned diametrically opposite one another (i.e., 180 degrees apart) such that the grooves 90 engage the locking protrusions 62 at predetermined rotational intervals as the support member 22*a* rotates with respect to the base 18. In particular, the grooves 90 engage the protrusions 62 every 180 degrees of rotation of the support member 22*a* with respect to the base 18 substantially corresponding with the first and second positions (described below). However, in alternative constructions, more or fewer grooves 90 may be included such that more or fewer engagement positions may be created (i.e., four lugs spaced 90 degrees apart to permit the protrusions 62 to engage the grooves 90 every 90 degrees of rotation).

During use, the first support member 22*a* is rotatable with respect to the base 18 about the first axis 66*a* between a first position where the apertures 78 are spaced a first distance from the cups 46, and a second position where the apertures 78 are spaced a second distance from the cups 46 different from the first distance. Generally speaking, the distance between the apertures 78 and the cups 46 at least partially determines the type of test tube 14 that may be stored in a particular storage station 26. As such, the storage stations 26 associated with the first support member 22*a* are configured to accommodate a first test tube type 14*a* when in the first position, and a second test tube type 14*b* when in the second position.

In the illustrated construction, the first support member 22*a* is configured to rotate about the axis 66*a* approximately 180 degrees between the first position and the second position. The bottom wall 70 of the first support member 22*a* is substantially parallel with the bottom portion 30 of the base 18 in each position, permitting a test tube 14 to pass through the apertures 78 and be at least partially received within a corresponding cup 46. Furthermore, to maintain the first support member 22*a* in each position, the first support member 22 is moved to a rotational position causing engagement between the locking grooves 90 and the locking protrusions 62.

Illustrated in FIGS. 1-5, the second support member 22*b* is substantially similar in construction to and operates in the same manner as the first support member 22*a*. The second support member 22*b* includes a pair of rotating lugs 82 configured to be received in the second pair of mounting apertures 54*b*, allowing the second support member 22*b* to rotate about the second axis 66*b* between the first and second positions. Still further, when the second support member 22*b* is mounted to the base 18, the apertures 78 of the second support member 22*b* substantially align with cups 46 that are different than those with which the apertures 78 of the first support member 22*a* are aligned.

To store test tubes in the test tube holder 10, the user first takes account of the number and type of test tubes to be stored (i.e., 10 of test tube 14*a* and 15 of test tube 14*b*). The user then adjusts the plurality of support members 22 such that the appropriate number of storage stations 26 are capable of accommodating each type of test tube 14*a*, 14*b*. More specifically, the user may separately rotate each of the first support member 22*a* and the second support member 22*b* to either the first and second positions to create the necessary stations 26. For example, if the user has all small volume test tubes 14*c*, the user may rotate both support members 22*a*, 22*b* to the second position (FIG. 2). Alternatively, if the user has all larger volume test tubes 14*a*, 14*b*, the user may rotate both support members 22*a*, 22*b* to the first position (FIG. 3). Still further, if the user has a combination of larger and small volume test tubes 14*a*, 14*b*, 14*c*, the user may rotate one support member 22*a* to the first position and rotate another support member 22*b* to the second position (FIG. 1). In this orientation, each of the support members 22*a*, 22*b* are positioned so that they are at appropriate and different distances from the bottom portion 30 in a step-like manner.

Once the test tube holder 10 is prepared, the user may insert each test tube 14 into an appropriate station 26 by passing the test tube 14 though an aperture 78 of the appropriate support member 22 until the bottom of the tube 14 is received within a corresponding cup 46 of the base. The combined support of the aperture 78 and the cup 46 maintain the test tube 14 in a substantially upright position. The process is repeated until all test tubes 14 are properly stored.

What is claimed is:

1. A test tube holder that is configurable to support a combination of a first test tube type and a second test tube type, the test tube holder comprising:

a base;

a first support member coupled to and rotatable with respect to the base between a first position, where the first support member is configured to support the first test tube type, and a second position, where the first support member is configured to support the second test tube type; and wherein the base defines a mounting aperture having a locking protrusion, wherein the first support member includes a rotating lug sized to be at least partially received within the mounting aperture and having a locking groove, and wherein the locking groove is positioned such that the locking groove engages the locking protrusion at predetermined rotational intervals as the rotating lug rotates with respect to the mounting aperture.

2. The test tube holder of claim 1, wherein the first support member defines an aperture sized to permit both the first test tube type and the second test tube type to pass therethrough.

3. The test tube holder of claim 2, wherein the base has a bottom portion, and wherein the aperture is spaced a first distance from the bottom portion when the first support member is in the first position, and wherein the aperture is spaced a second distance from the bottom portion when the first support member is in the second position.

4. The test tube holder of claim 1, wherein the base defines a cup therein.

5. The test tube holder of claim 1, wherein the first support member is rotatable with respect to the base through approximately 180 degrees between the first position and the second position.

6. The test tube holder of claim 1, further comprising a second support member coupled to the base and rotatable with respect to the base independent of the first support member, the second support member being movable between a first position where the second support member is configured to support the first test tube type, and a second position where the second support member is configured to support the second test tube type.

7. The test tube holder of claim 6, wherein the second support member is rotatable with respect to the base through approximately 180 degrees between the first position and the second position.

8. A test tube holder comprising:

a base;

a first support member defining an aperture therein, the first support member being coupled and rotatable with respect to the base between a first position, where the aperture is a first distance from the base, and a second position, where the aperture is a second distance from the base different than the first distance; and wherein the base defines a mounting aperture having a locking protrusion, wherein the first support member includes a rotating lug sized to be at least partially received within the mounting aperture and having a locking groove, and wherein the locking groove is positioned such that the locking groove engages the locking protrusion at predetermined rotational intervals as the rotating lug rotates with respect to the mounting aperture.

9. The test tube holder of claim 8, further comprising a second support member defining an aperture therein, the second support member being coupled to the base and rotatable independent of the first support member with respect to the base, the second support member movable between a first position where the aperture of the second support member is a first distance from the base, and a second position where the aperture of the second support member is a second distance from the base different than the first distance.

10. The test tube holder of claim 8, wherein the base defines a cup, and wherein the aperture is vertically aligned with the cup when the first support member is in the first position or the second position.

11. A test tube holder configured to support a combination of a first test tube type and a second test tube type, the test tube holder comprising:

a base;

a plurality of support members adjustably coupled to the base;

a plurality of test tube stations, wherein each support member of the plurality of support members at least partially defines a unique portion of the test tube stations, and wherein each support member is adjustable between a first position wherein the unique portion of test tube stations is configured to support the first test tube type, and a second position wherein the unique portion of test tube stations is configured to support the second test tube type and wherein the base defines a mounting aperture having a locking protrusion, wherein a first support member of the plurality of support members includes a rotating lug sized to be at least partially received within the mounting aperture and having a locking groove, and wherein the locking groove is positioned such that the locking groove engages the locking protrusion at predetermined rotational intervals as the rotating lug rotates with respect to the mounting aperture.

* * * * *